US005785701A

United States Patent [19]

Sams et al.

[11] Patent Number: 5,785,701

[45] Date of Patent: Jul. 28, 1998

[54] STERILE VIAL CONNECTOR ASSEMBLY FOR EFFICIENT TRANSFER OF LIQUID

[75] Inventors: Bernard Sams, London; Colin James Matthews, Hertfordshire, both of United Kingdom; Jean Claude Thibault, Saint Egreve; Hubert Jansen, Haute Jarrie, both of France

[73] Assignee: Becton Dickinson and Company, Franklin Lakes, N.J.

[21] Appl. No.: 714,873

[22] Filed: Sep. 17, 1996

[51] Int. Cl.[6] ..... A61J 1/00

[52] U.S. Cl. ..... 604/411; 604/403; 604/414; 604/415; 604/416

[58] Field of Search ..... 604/283, 403, 604/411–416, 905; 206/219–222; 215/287

[56] References Cited

U.S. PATENT DOCUMENTS

| | | | |
|---|---|---|---|
| 4,020,839 | 5/1977 | Klapp | 604/414 |
| 5,217,433 | 6/1993 | Bunin | 604/416 |
| 5,323,109 | 6/1994 | Tirrell et al. | 604/415 |
| 5,348,548 | 9/1994 | Meyer et al. | 604/416 |
| 5,358,501 | 10/1994 | Meyer | 604/414 |
| 5,385,546 | 1/1995 | Kriesel et al. | 604/414 |
| 5,487,737 | 1/1996 | Meyer | 604/416 |
| 5,620,434 | 4/1997 | Brony | 604/415 |

*Primary Examiner*—Robert A. Clarke
*Assistant Examiner*—David J. Cho
*Attorney, Agent, or Firm*—Allen W. Wark

[57] ABSTRACT

A connector assembly is provided for efficient flow of liquid into and/or out of a vial, such as a vial containing a lyophilized drug. The connector assembly includes a spike and a stopper sleeve, both slidably mounted in the open top of the vial. The connector assembly includes a stopper affixed to the stopper sleeve and sealingly engaged in the open top of the vial. The stopper is slidably moveable in response to axial movement of the stopper sleeve. Movement of the stopper sleeve relative to the vial will move the stopper into or out of sealing engagement with the vial. The connector assembly further includes a spring for generating a small amount of axial movement of the spike, stopper sleeve and stopper after the stopper has been moved into the opened position in the vial. Movement of the spike, stopper sleeve and stopper generated by the spring will cause a sufficient change in pressure to overcome surface tension and initiate an efficient flow of fluid into or out of the vial.

7 Claims, 11 Drawing Sheets

STERILE VIAL CONNECTOR ASSEMBLY FOR EFFICIENT TRANSFER OF LIQUID

BACKGROUND OF THE INVENTION

1. Field of the Invention. The subject invention relates to a connector assembly for a vial, and more particularly, to a connector assembly for a vial that enables an efficient transfer of liquid into or out of the vial.

2. Description of the Prior Art. Many drugs are presented in dry form to achieve a longer shelf life. One type of dry drug is a lyophilized drug. A selected dose of a lyophilized drug may be stored in a glass vial that is sealed to prevent deterioration or contamination of the drug. A liquid solvent may be mixed with the lyophilized drug shortly prior to use, and the drug solution may be administered to a patient.

Some prior art vials of lyophilized drugs are sealed with a membrane that can be pierced by a needle or spike for delivering the liquid solvent into the vial and for subsequently administering the drug solution to a patient. It has been found, however, that fragments of the membrane can separate when the seal is being pierced, and thus inadvertently can be administered to a patient with the drug solution.

Other prior art vials include a rubber stopper that is urged into the vial by the spike, needle or other tubular structure that delivers the solvent to the vial. These stoppers cannot be conveniently accessed after they have fallen into the vial for reliably resealing the vial of drug solution. However, the loose stopper can unintentionally block the vial opening to impede the outflow of drug solution.

A very effective vial connector assembly is shown in U.S. Pat. No. 5,358,501 which issued to Gabriel Meyer on Oct. 25, 1994. Certain embodiments of the assembly shown in U.S. Pat. No. 5,358,501 include a tube with a proximal end in the vial and a distal end externally of the vial. First and second channels extend axially through the tubes. The first channel terminates at a first orifice at the extreme proximal end of the tube. The second channel terminates at a second orifice disposed distally of the first orifice. Portions of the tube defining the first orifice prevent the stopper from blocking the second orifice. Hence a drug solution in the vial can be completely emptied for administration to a patient. Other embodiments shown in U.S. Pat. No. 5,358,501 attach the stopper to the tubular structure that urges the stopper into the vial. Thus, the stopper does not fall to the bottom of the vial. This enables the vial to be re-sealed and further prevents the stopper from inadvertently falling into a position where the stopper can impede the flow of drug solution from the vial.

In many situations it is desirable to utilize a pointed spike on the vial connector to access a supply of solvent held in a container, such as a rigid container. It has been found that surface tension at the gas/liquid interface and a pressure differential between the vial and the container of solvent prevents the initial flow of solvent into the vial. Similar problems with pressure differential and surface tension may occur when the drug solution is being delivered from the vial. Where the container is a flexible container, such as a flexible infusion bag, it may be possible to squeeze the infusion bag to initiate fluid flow. However, if the container is rigid, this approach is not possible. Some medical practitioners overcome this problem by shaking the vial after it has been connected to the supply of solvent. However, this shaking can inadvertently separate the vial from the supply of solvent and can lead to a loss or contamination of the drug or drug solution. Furthermore, shaking an assembly with a pointed implement is an unsafe practice.

SUMMARY OF THE INVENTION

The subject invention is directed to a connector for use with a vial. The vial includes a bottom wall and an upstanding side wall. A shoulder extends inwardly from the top end of the side wall and a tubular neck extends upwardly from the shoulder to an open top. An annular rim may extend around portions of the neck that define the open top. Portions of the vial between the tubular neck and the bottom wall define an enclosure in which a lyophilized drug or a drug solution may be stored.

The connector includes an elongate transfer tube slidably mounted in the tubular neck of the vial for movement between proximal and distal positions in the neck of the vial. The transfer tube includes a proximal end disposed within the vial and a distal end projecting from the vial. The distal end may be pointed sufficiently to pierce through a seal on a separate fluid container, such as a rigid container containing a solvent. The proximal end of the transfer tube includes mounting structure for engagement with a stopper. Portions of the transfer tube distally of the locking structure include apertures for permitting transverse flow of fluid into or out of at least one of the channels passing axially through the transfer tube.

The connector further includes a stopper secured to a stopper sleeve. The stopper is dimensioned to sealingly engage the inner surface of the neck of the vial when the transfer tube is in its extreme distal position relative to the neck. Proximal movement of the stopper sleeve urges the stopper proximally beyond the neck of the vial and places the transverse apertures through the transfer tube in communication with interior portions of the vial.

The connector of the subject invention or any of the components of the connector can be configured so as to have a minimum of two positions, relative to the neck of the vial. In one configuration, a spring is provided in proximity to the transfer tube. The spring is dimensioned and disposed to bias the transfer tube distally as the transfer tube reaches its extreme proximal position. The spring may be unitarily molded as part of the transfer tube. The spring effect can be imparted by bending or torsion of a flexible material forming the spring, or by the flexibility of the spring material itself The spring may be substantially annular, and may define a circumferentially extending wave that resiliently yields in response to axially directed pressure thereon.

The connector of the subject invention may further include a mounting collar mounted to and surrounding the open top of the vial and slidably receiving the transfer tube therein. The collar may include a plurality of deflectable latches disposed and dimensioned to lockingly engage the annular rim surrounding the opening top of the vial. A seal may be disposed at the interface of the vial and the collar.

In use, a dry drug such as a lyophilized drug is stored in the vial and is protectively sealed by the stopper. Solvent may be added to the lyophilized drug in the vial by placing the distal end of the transfer tube into communication with a container of solvent. The stopper sleeve is then urged proximally relative to the collar and the vial, such that the stopper secured to the proximal end of the stopper sleeve moves proximally in the neck of the vial. As the stopper sleeve approaches its extreme proximal position, the stopper will clear the neck of the vial to enable fluid communication between the container of solvent and the vial. More particularly, a clear path for fluid communication will be defined by at least one of the channels extending axially through the transfer tube and the transverse apertures disposed distally of and adjacent to the stopper.

As noted above, surface tension and pressure differentials between the vial and the supply of solvent often impede an efficient flow of solvent into the vial. In the prior art, this problem had been addressed by shaking the vial, the connector assembly and container of fluid to initiate flow. This prior art shaking was undesirable for reasons explained above. The connector of the subject invention overcomes the problems caused by surface tension and pressure differentials, and generates a rapid flow of liquid into the vial. More particularly, the transfer tube, stopper sleeve and stopper will move proximally relative to the vial in response to movement generated by the health care worker attempting to add solvent to the lyophilized drug. As the transfer tube leaves at least one of its extreme proximal positions, the spring will exert distally directed forces on the transfer tube relative to the vial. These forces can readily be overcome by the health care worker utilizing the vial and the subject connector assembly. However, after the transfer tube, stopper sleeve and stopper reach their extreme proximal position and connecting forces are released by the health care worker, forces exerted by the spring will urge the transfer tube, stopper sleeve and stopper slightly distally relative to the vial. This movement of the transfer tube relative to the vial is sufficient to overcome surface tension and to generate a favorable pressure differential that will generate immediate flow of liquid through the transfer tube and into the vial.

DETAILED DESCRIPTION OF THE PREFERRED EMBODIMENTS

Figure 1:
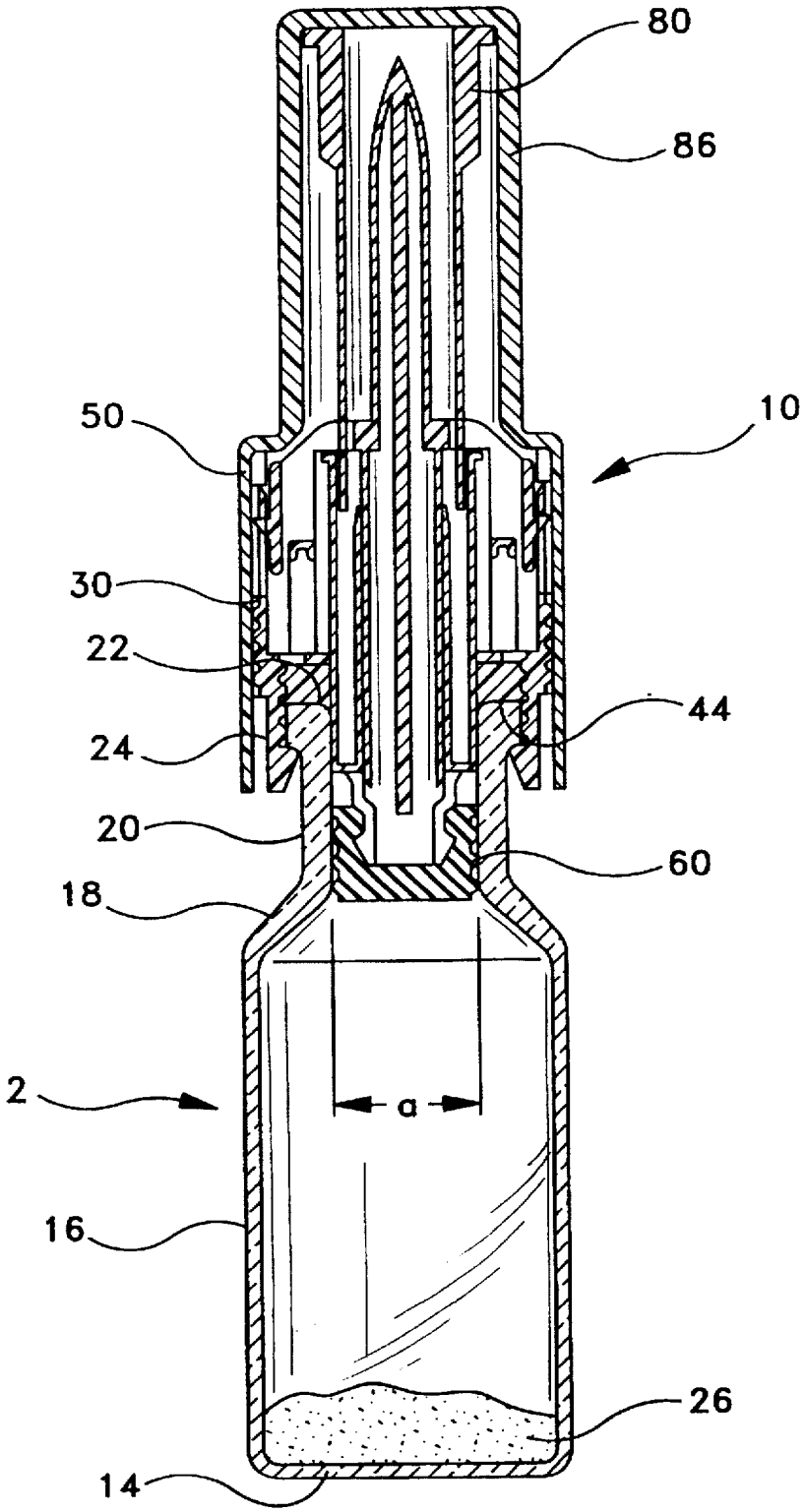
FIG. 1 is a longitudinal cross-sectional view of a connector assembly in accordance with the subject invention mounted to a vial.

A connector assembly in accordance with the subject invention is identified generally by the numeral 10 in FIG. 1. The connector assembly 10 is used with a glass vial 12 having a bottom wall 14, a cylindrical side wall 16 extending upwardly from bottom wall 14, a shoulder 18 extending inwardly and upwardly from the end of cylindrical side wall 16 remote from bottom wall 14 and a cylindrical neck 20 of inside diameter "a" extending upwardly from shoulder 18. Neck 20 terminates at an open top 22. Top 22 is characterized by an annular rim 24 objecting outwardly thereabout.

Vial 12 is provided with a lyophilized drug 26 stored therein. Connector assembly 10 functions to safely seal lyophilized drug 26 in vial 12 and to permit a solvent to be added to vial 12 for mixing with lyophilized drug 26 and forming a drug solution. Connector 10 further enables delivery of the drug solution to an IV set for administration to a patient.

Figure 2:
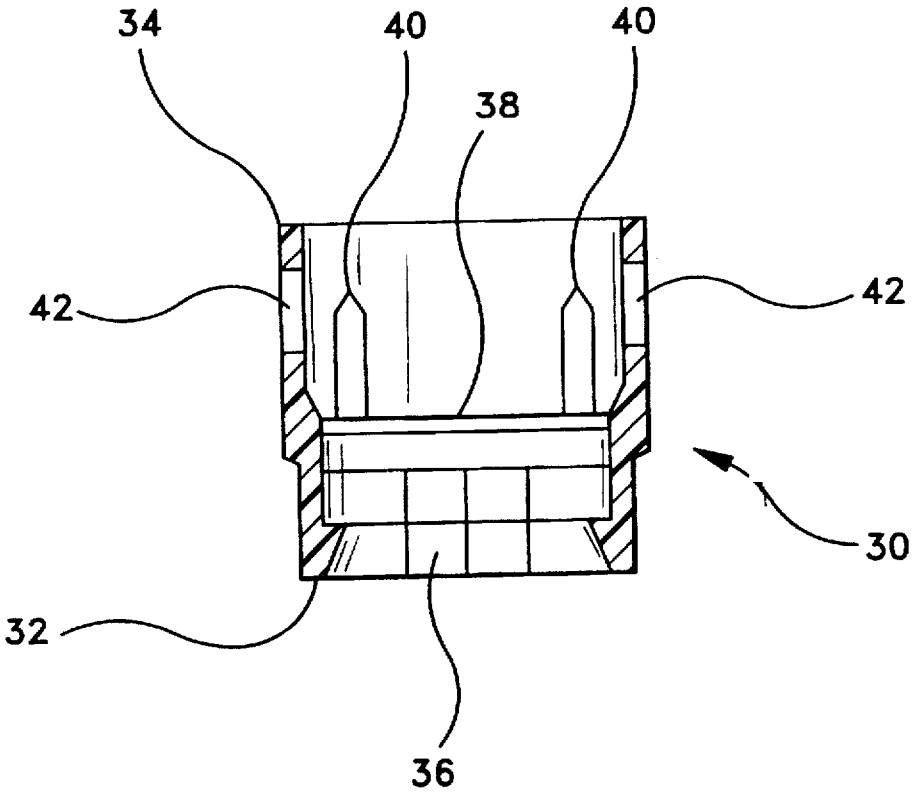
FIG. 2 is a cross-sectional view of the collar of FIG. 1.

Connector assembly 10 includes a generally annular collar 30. As shown most clearly in FIG. 2, collar 30 has opposed proximal and distal ends 32 and 34 respectively. Proximal end 32 of collar 30 is defined by a plurality of deflectable latches 36 dimensioned for locked engagement with annular rim 24 of vial 12. Portions of collar 30 between proximal and distal ends 32 and 34 define a radially inwardly extending annular ledge 38 having an inside diameter approximately equal to the inside diameter "a" of neck 20 of the vial 12. A pair of diametrically opposed spring pushers 40 extend distally from annular ledge 38 and terminate at a location intermediate ledge 38 and distal end 34 of collar 30. Collar 30 further includes a pair of diametrically opposed positioning windows 42 approximately aligned with spring pushers 40.

Connector assembly 10 further includes an annular seal 44, as shown in FIG. 1. Seal 44 has an inside diameter approximately equal to or slightly greater than inside diameter "a" of neck 20 on vial 12 and an outside diameter selected for sealing engagement with inner circumferential portions of collar 30. Seal 44 is positioned between top end 22 of vial 12 and annular ledge 38 of collar 30 when latches 36 of collar 30 are lockingly engaged with annular rim 24 of vial 12, as shown most clearly in FIG. 1.

Figure 3:
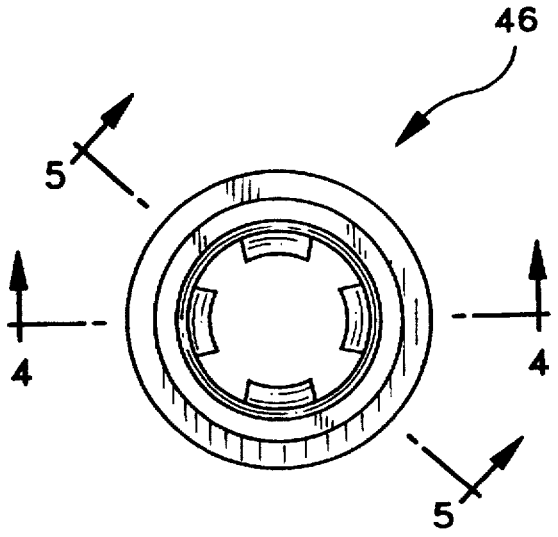
FIG. 3 is a top plan view of the stopper sleeve shown on the connector of FIG. 1.
Figure 5:
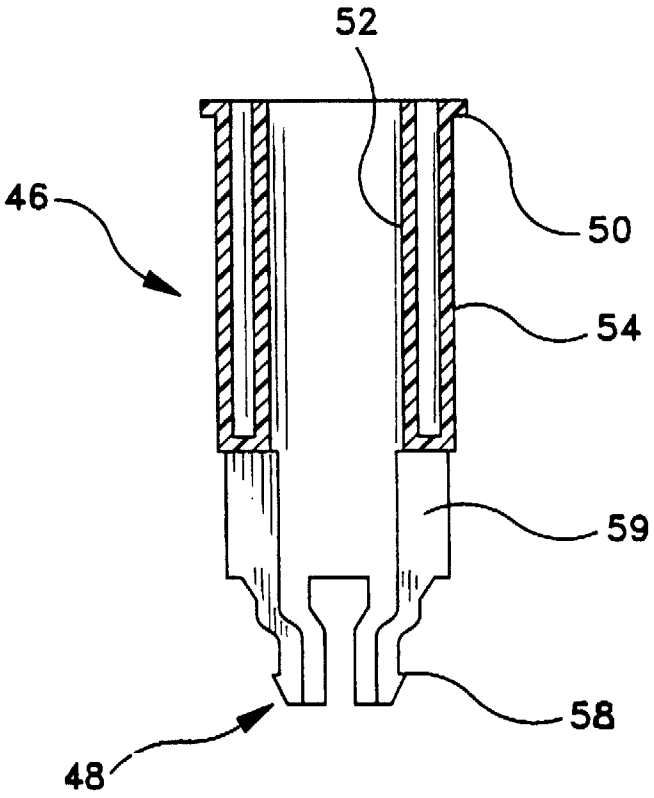
FIG. 5 is a cross-sectional view taken along line 5—5 in FIG. 3.
Figure 4:
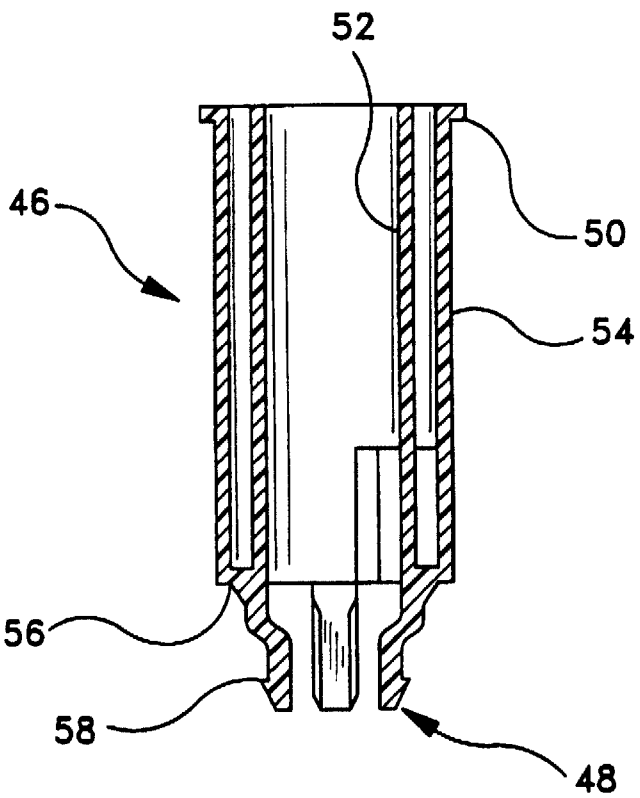
FIG. 4 is a cross-sectional view taken along line 4—4 in FIG. 3.

Connector assembly 10 further includes a generally tubular stopper sleeve 46, as shown in FIGS. 3–5. Stopper sleeve 46 has a proximal end 48, an opposed distal end 50 and a central passage extending axially therebetween. Distal portions of stopper sleeve 46 are characterized by inner and outer concentrically disposed cylindrical walls 52 and 54 defining an annular space therebetween. Outer cylindrical wall 54 defines an outside diameter slightly less than inside diameter "a" of neck 20 on vial 12, but sufficiently large for sliding fluid tight engagement with seal 44. Inner and outer cylindrical walls 52 and 54 of stopper sleeve 46 are connected to one another by a transverse support wall 56. A plurality of deflectable gripping fingers 58 extend proximally from transverse wall 56 to proximal end 48 of stopper sleeve 46. Slots 59 accommodate a flow of fluid as explained below.

A vial stopper 60 is grippingly engaged on fingers 58 of stopper sleeve 46 as shown in FIG. 1. Stopper 60 is dimensioned for sliding fluid tight engagement with interior surfaces of neck 20 of vial 12. Stopper 60 is dimensioned to terminate a selected axial distance from transverse wall 56 of stopper sleeve 46. As a result, a gap between stopper 60 and transverse wall 56 is provided to permit fluid communication through slots 59, between stopper 60 and transverse wall 56 as explained further herein.

Figure 8:
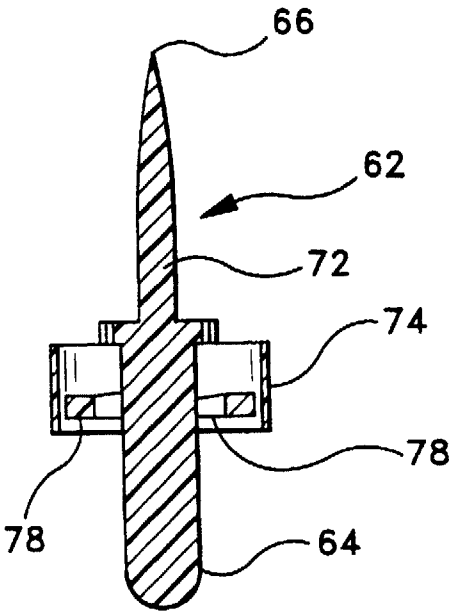
FIG. 8 is a cross-sectional view taken along line 8—8 in FIG. 7.
Figure 7:
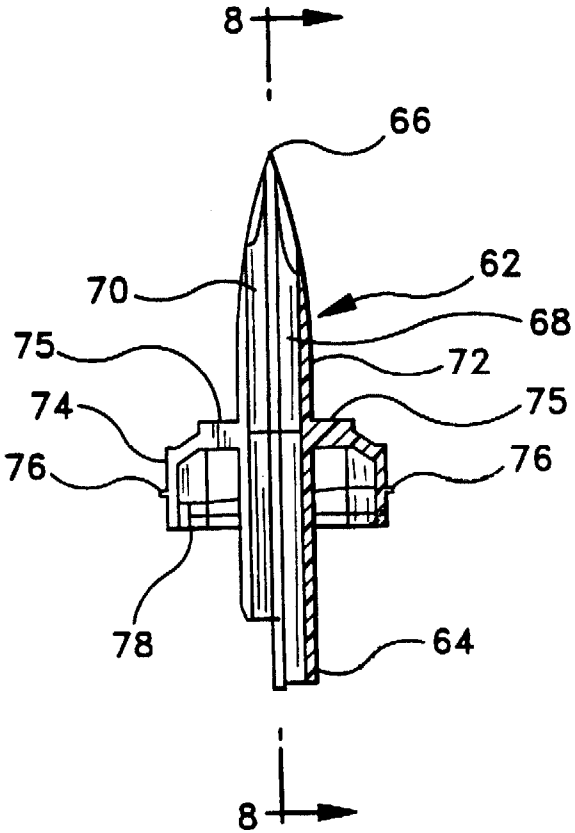
FIG. 7 is a cross-sectional view taken along line 7—7 in FIG. 6.
Figure 6:
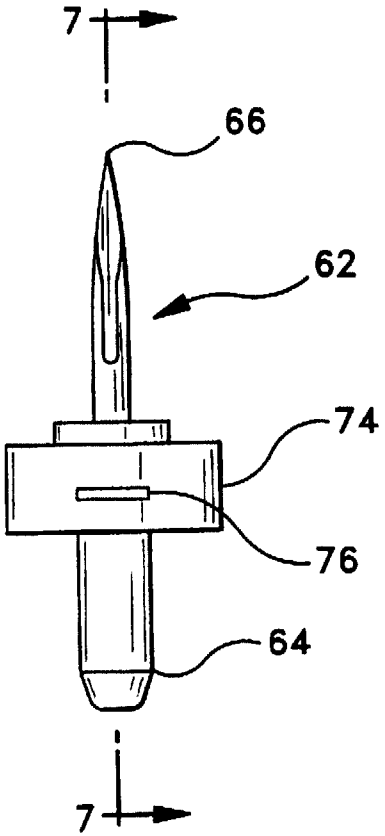
FIG. 6 is a side elevational view of the spike shown in FIG. 1.

Connector assembly 10 further includes a tubular spike 62 unitarily molded from a thermoplastic material as shown in FIGS. 6–8. Spike 62 can be formed as an elongate structure having a proximal end 64, a pointed distal end 66 and a pair of axially extending passages 68 and 70 extending therethrough and separated from one another by a septum 72. Spike 62 is formed such that passages 68 and 70 have different axial termini for substantially eliminating any possibility of both passages being obstructed by structure in either the vial 12 or a separate container with which connector assembly 10 may communicate. Portions of tubular spike 62 near proximal end 64 define an outside diameter that permits sliding engagement within inner wall 52 of stopper sleeve 46.

Spike 62 further includes an annular wall 74 fixed at an intermediate position by radial arms 75. Annular wall 74 defines an outside diameter selected for slidable insertion within distal end 34 of collar 30. A pair of diametrically opposed projections 76 extend outwardly from annular wall 74 at locations intermediate the length of annular wall 74. Projections 76 are dimensioned and configured to be lockingly received within windows 42 in collar 30.

Spike 62 further includes two arcuately generated springs 78 disposed within annular wall 74 and dimensioned for engagement by spring pushers 40 of collar 30. Springs 78 can be formed from any suitable material such as ABS, POM, or any thermoplastic exhibiting desired elasticity characteristics. Springs 78 are deflectable in an axial direction in response to forces generated thereon by spring pushers 40.

Figure 10:
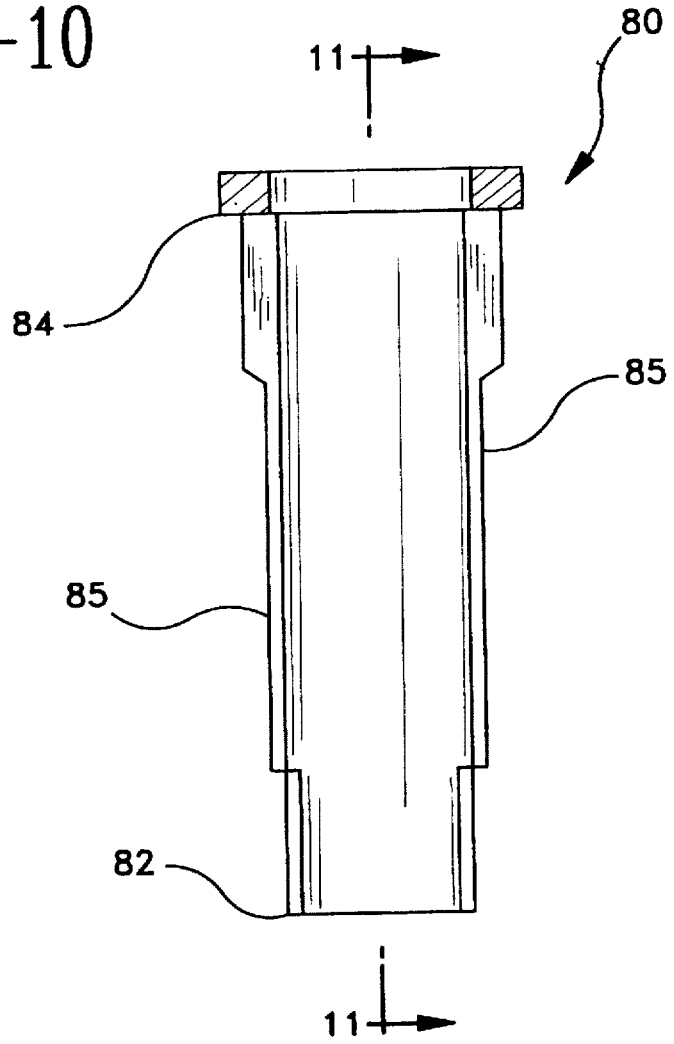
FIG. 10 is a cross-sectional view taken along line 10—10 in FIG. 9.
Figure 9:
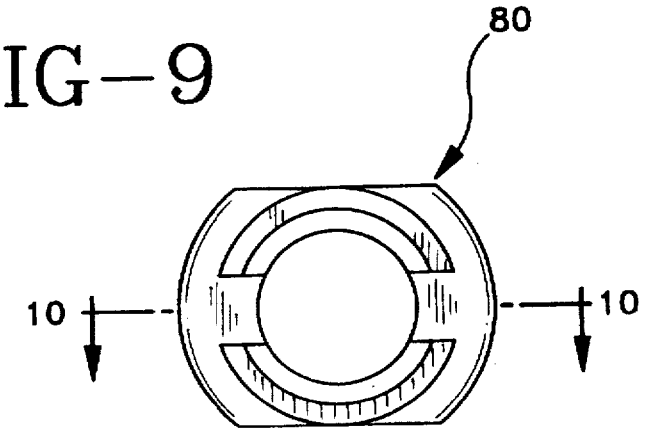
FIG. 9 is a top plan view of a spike guard shown in FIG. 1.
Figure 11:
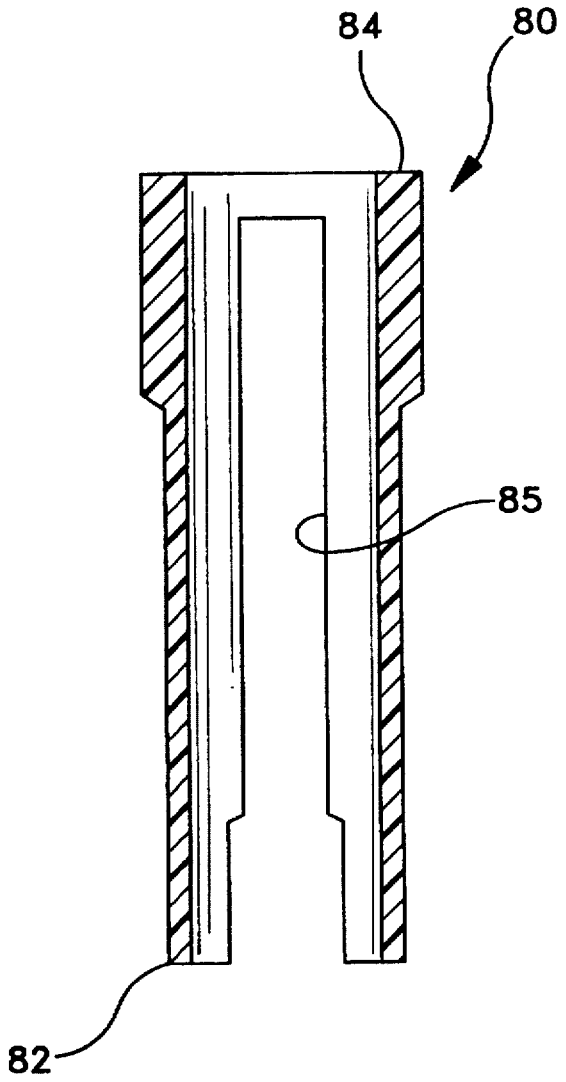
FIG. 11 is a cross-sectional view taken along line 11—11 in FIG. 10.
Figure 12:
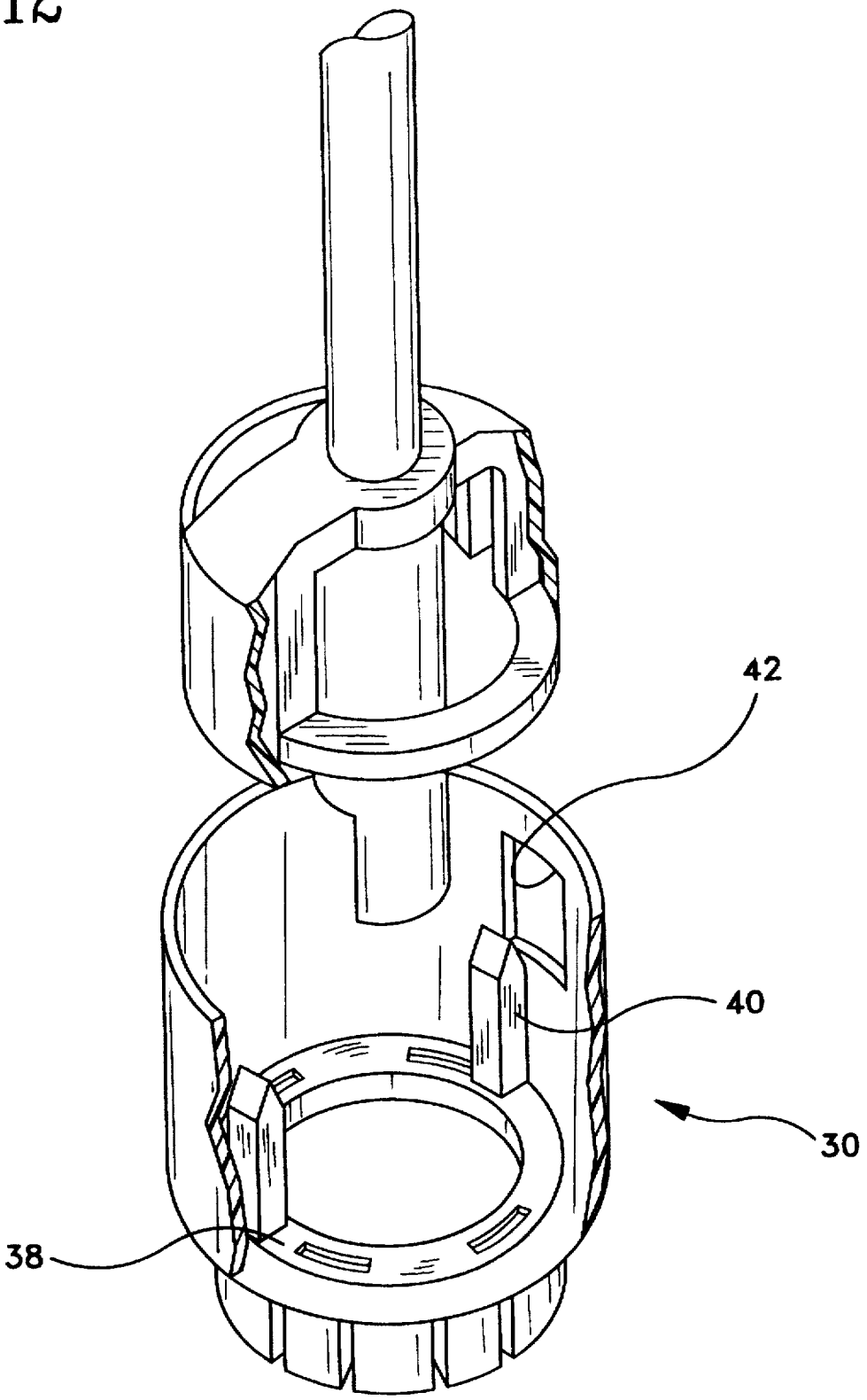
FIG. 12 is an exploded perspective view, partly in section, of the collar and spike.

Connector assembly 10 further includes a generally tubular spike guard 80 having opposed proximal and distal ends 82 and 84 as shown in FIGS. 9–11. Slots 85 extend distally from proximal end 82 and are dimensioned to receive radial arms 75 of spike 62. Proximal end 82 of spike guard 80 can be retained, by frictional or mechanical means, in a distal position in the annular space between inner and outer circumferential walls 52 and 54 of stopper sleeve 46. However, spike guard 80 is slidably moveable in the annular space between inner and outer walls 52 and 54 of stopper sleeve 46 in response to proximally directed forces on spike guard 80. Spike guard 80 defines an axial length sufficient for distal end 84 to protectively surround pointed distal end 66 of spike 62.

Connector assembly 10 further includes a safety shield 86, as shown in FIG. 1, which is releasably engaged around outer circumferential portions of collar 30 and dimensioned for protectively enclosing spike guard 80 and spike 62.

Figure 13:
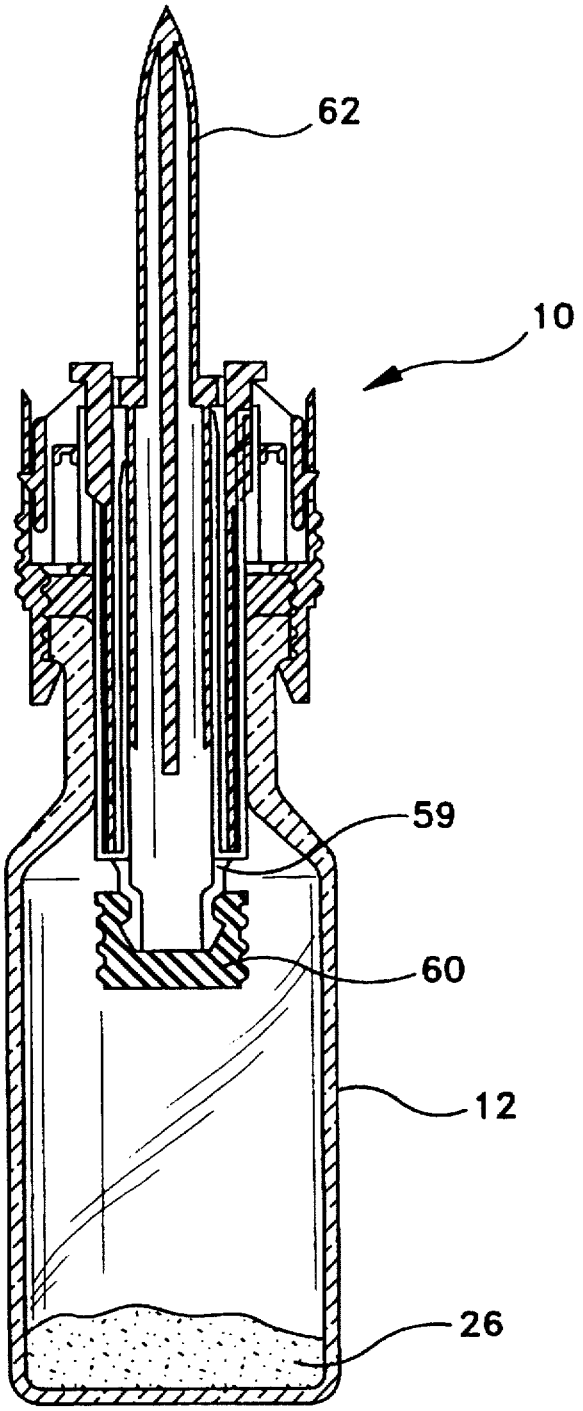
FIG. 13 is a cross-sectional view of the connector assembly similar to FIG. 1 but showing the stopper in the vial and the spring deflected.

Connector assembly 10 is employed by initially removing safety shield 86. Vial 12, with connector assembly 10 mounted thereto, is urged toward a source of solvent held in a rigid container such that distal end 84 of spike guard 80 aligns with and is urged against an appropriate fitting on the rigid container. Continued force exerted on vial 12 will cause proximal end 82 of spike guard 80 to slide proximally into the annular space between inner and outer walls 52 and 54 of stopper sleeve 46. This proximal movement of spike guard 80 relative to spike 62 will cause radial arms 75 of spike 62 to slide distally in slots 85 of spike guard 80. Simultaneously, distal tip 66 of spike 62 will become exposed and pass into the appropriate fitting on the rigid container. Continued force on vial 12 will generate two separate movements within connector assembly 10. First, spike guard 80 will generate forces on stopper sleeve 46 and will cause stopper sleeve 46 and stopper 60 mounted thereto to slide proximally within neck 20 of vial 12. Sufficient proximal movement will cause stopper 60 to slide sufficiently in a proximal direction to clear neck 20 of vial 12 and to permit fluid communication through slots 59 between stopper 60 and transverse wall 56 of stopper sleeve 46 into portions of vial 12 below shoulder 18, as shown in FIG. 13. Second, these forces on vial 12 will cause spring pushers 40 to exert forces on spring 78 sufficient for spring 78 to deflect relative to remaining portions of spike 62. As a result, remaining portions of spike 62 will move in a proximal direction relative to collar 30 and vial 12.

Figure 14:
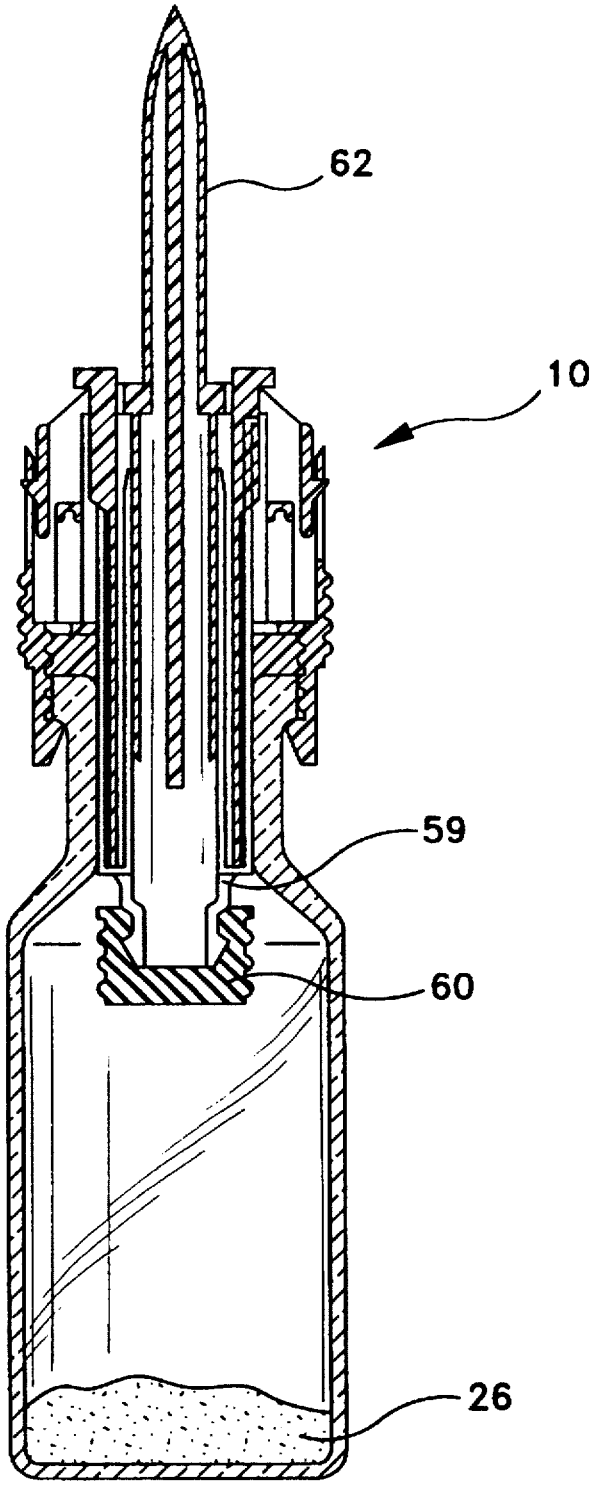
FIG. 14 is a cross-sectional view similar to FIG. 13, but showing the spring resiliently returned to an unbiased condition.

The forces on vial 12 will place the interior of vial 12 in communication with solvent in the rigid container. More particularly, fluid communication will be achieved through one of passages 68 or 70 of spike 62, through proximal portions of inner wall 52 of stopper sleeve 46 and through slots 59 between stopper 60 and transverse wall 56 of stopper sleeve 46. However, as explained above, pressure conditions and surface tension impede flow of solvent through spike 62. This problem is overcome by connector assembly 10. More particularly, upon release of forces on vial 12 that had been generated to urge spike 62 into the supply of solvent, spring 78 will resiliently return toward an undeflected condition. This resilient movement of spring 78 will cause a small corresponding movement of remaining portions of spike 62, stopper sleeve 46 and stopper 60 relative to collar 30 and vial 12 as shown in FIG. 14. This small relative movement of spike 62, stopper sleeve 46 and stopper 60 generated by spring 78 will vary volume sufficiently to cause a minor pressure change that will overcome surface tension and static pressure conditions that would otherwise impede flow of solvent. As a result, solvent will flow through one of channels 68 or 70 of spike 62 and into vial 12 for mixture with lyophilized drug 26.

Figure 16:
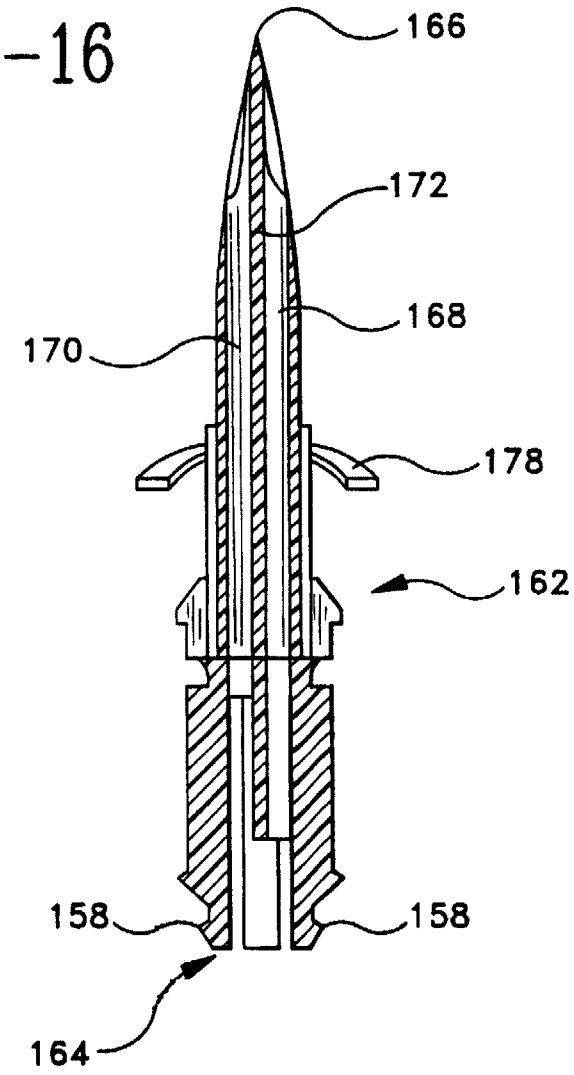
FIG. 16 is a cross-sectional view taken along line 16—16 in FIG. 15.
Figure 15:
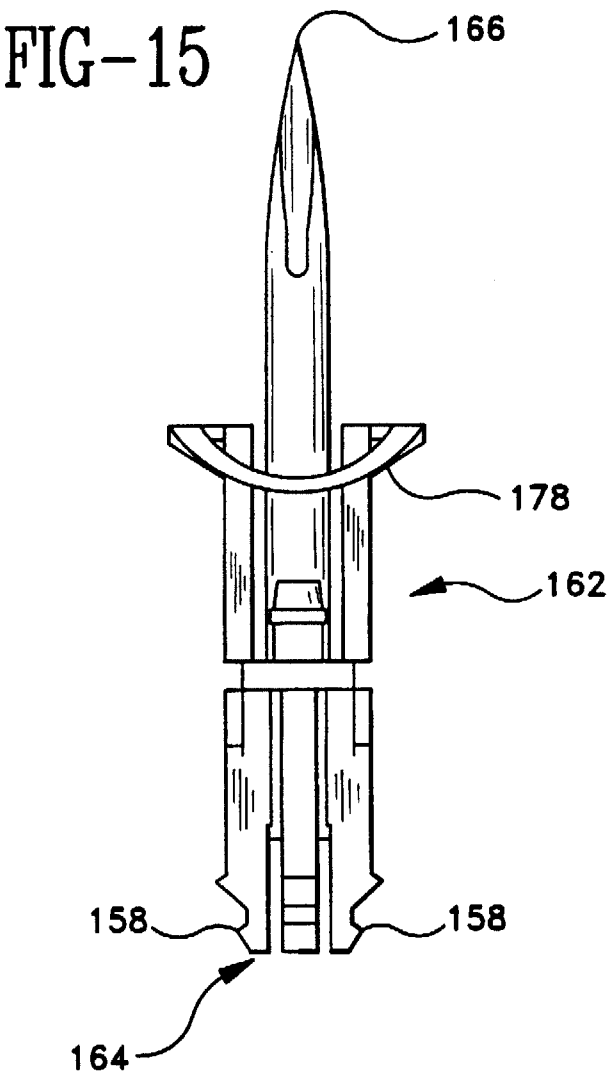
FIG. 15 is a side elevational view of an alternate spike.

An alternate spike is illustrated in FIGS. 15 and 16, and is identified generally by the numeral 162. Spike 162 includes opposed proximal and distal ends 164 and 166 respectively. Channels 168 and 170 extend between the opposed ends and are separated from one another by a septum 172. Spike 162 includes a spring 178 that is structurally and functionally similar to spring 78 on spike 62 described and illustrated above. However, spike 162 does not include an annular wall surrounding spring 178 for latched connection to a collar to prevent separation between the spike and the collar. Rather, spike 162 is provided with stopper fingers 158 at distal end 164. Stopper fingers 158 are structurally similar to the fingers 58 on the stopper sleeve described above and illustrated in FIGS. 1, 3, 4 and 5. In the embodiment of FIGS. 15 and 16, the stopper is substantially identical to the stopper 60 described above and illustrated in FIG. 1 is mounted directly to stopper fingers 158 of spike 162. Frictional engagement between the stopper and the neck of the vial function to hold spike 162 in fixed relationship to the vial.

Figure 17:
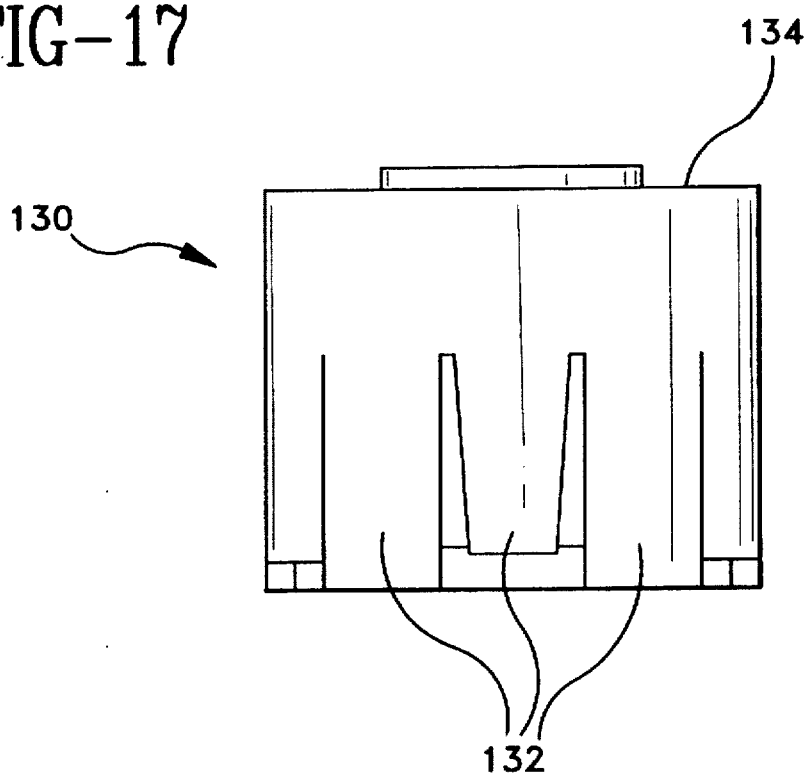
FIG. 17 is a side elevational view of a collar for use with the spike of FIGS. 15 and 16.
Figure 18:
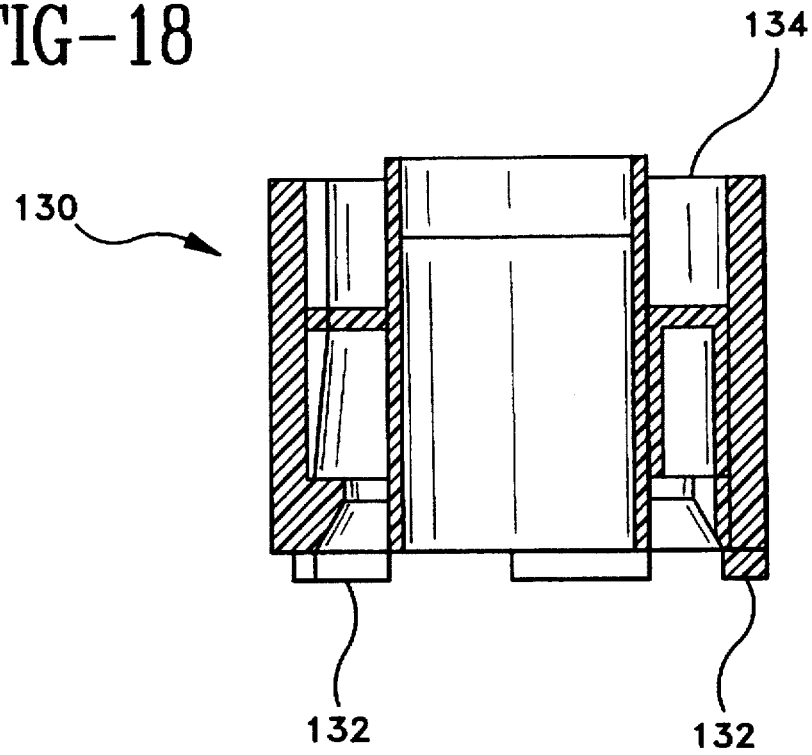
FIG. 18 is a cross-sectional view taken along line 18—18 in FIG. 17.

A collar 130 for use with spike 162 is illustrated in FIGS. 17 and 18. Collar 130 is structurally and functionally similar to collar 30 described above and illustrated in FIG. 1. In particular, collar 130 includes deflectable latches 132 that are disposed and dimensioned for locked engagement with annular rim 24 on vial 12 as described and illustrated above. Collar 130 is not provided with apertures for locked engagement with spike 162 and has no spring pushers. Rather, spring 178 of spike 162 will engage against distal end 134 of collar 130 for generating the small movement of spike 162 that facilitates the initial flow of solvent therethrough.

What is claimed is:

1. A connector assembly for a vial, said vial having a tubular neck, said connector assembly comprising:

a stopper slidably mounted in said tubular neck of said vial;

a transfer tube having a spike and a proximal end functionally engaged with said stopper, and said spike having a pointed distal end disposed externally of said vial and at least one fluid passage extending axially from said distal end to a location in said vial distally of said stopper, said transfer tube being slidably moveable between a distal position where said stopper is in said neck and a proximal position where said stopper is at a location in said vial spaced from said neck, wherein the functional engagement of said transfer tube with said stopper comprises a stopper sleeve in sliding telescoping engagement with said spike, said stopper sleeve defining said proximal end of said transfer tube, such that said stopper is securely engaged with said stopper sleeve; and a spring disposed between said vial and portions of said transfer tube external of said vial for urging said transfer tube distally from said proximal position of said transfer tube in said vial, whereby said movement of said transfer tube varies pressure sufficiently to permit efficient flow of fluid into said vial.

2. The connector assembly of claim 1, further comprising a collar rigidly connected to said vial, said transfer tube being slidably engaged with said collar.

3. The connector assembly of claim 2, wherein said spring is engageable with said collar when said transfer tube is in said proximal position for urging said transfer tube distally relative to said vial and said collar.

4. The connector assembly of claim 2, wherein said transfer tube and said collar lockingly engaged for preventing separation of said transfer tube from said collar.

5. The connector assembly of claim 1, further comprising a spike guard protectively surrounding said distal end of said spike, said spike guard being slidable in a proximal direction relative to said spike in response to forces exerted thereon for permitting selective exposure of said pointed distal end of said spike.

6. The connector assembly of claim 1, wherein said spring is unitarily formed with said transfer tube.

7. The connector assembly of claim 6, wherein said spring is an annular spring.

* * * * *